United States Patent [19]

Birnel et al.

[11] Patent Number: 4,656,755

[45] Date of Patent: Apr. 14, 1987

[54] CARPET BANDING CAPPER

[76] Inventors: Donald A. Birnel, 803 N. Piere; Kenneth G. Manson, 3506 Birch Vale, both of Wenatchee, Wash. 98801

[21] Appl. No.: 850,127

[22] Filed: Apr. 10, 1986

[51] Int. Cl.[4] ..... G01B 3/00

[52] U.S. Cl. ..... 33/526; 33/527; 33/613

[58] Field of Search ..... 33/526, 527, 180 R, 33/181 R, 169 R, 188, DIG. 20, 189

[56] References Cited

U.S. PATENT DOCUMENTS

| | | | |
|---|---|---|---|
| 2,144,697 | 1/1939 | Zangrando | 33/527 |
| 3,217,393 | 11/1965 | Johnson | 33/526 |
| 3,626,600 | 12/1971 | Gaither | 33/180 R |
| 4,110,911 | 9/1978 | Sucheck | 33/483 |
| 4,541,217 | 9/1985 | Stewart | 33/188 |

*Primary Examiner*—Willis Little

*Attorney, Agent, or Firm*—Harvey B. Jacobson

[57] ABSTRACT

A fitting is provided for locating and securing a channel-shaped carpet edging cap along the bottom of a wall at a predetermined height above a floor or carpet surface. The fitting comprises an angle section base member and a cap-supporting member adjustably mounted on the base member so that an upper edge of the cap-supporting member can be adjusted to the required height of the cap. In use, the cap is supported on the upper edge of the cap-supporting member in contact with the wall and is secured to the wall by staples which are applied through notches formed in the cap-supporting member.

5 Claims, 3 Drawing Figures

CARPET BANDING CAPPER

BACKGROUND OF THE INVENTION

This invention relates generally to the field of carpet laying and finishing.

Sometimes, when laying wall to wall carpeting, a length of carpet is secured along the base of a wall or walls, in a manner akin to a baseboard and the upper edge of the carpet is trimmed by inserting the upper edge into a channel-shaped elongate carpet cap which may be made of light guage plastic or other material. Generally, the cap is secured to the wall before the strip of carpet. Thereafter the upper edge of the carpet is then squeezed into the fitted cap.

It is an object of the invention to provide a method and apparatus whereby the cap may be accurately located and secured to a wall at predetermined height above a floor or carpet surface prior to insertion of a strip of carpet therein.

Applicant is aware of the following U.S. patents relating to nailing guides, templates and the like. None of these, however, discloses the features of the present invention.

U.S. Pat. No. 3,416,485; Pillips; Dec. 17, 1968;
U.S. Pat. No. 3,570,133; Halward; Mar. 16, 1971;
U.S. Pat. No. 3,678,586; Weber; July 25, 1972;
U.S. Pat. No. 4,037,632; Arena; July 26, 1977;
U.S. Pat. No. 4,079,764; Hayes; Mar. 21, 1978;
U.S. Pat. No. 4,435,906; Mori; Mar. 13, 1984.

SUMMARY OF THE INVENTION

In one of its aspects the invention provides a fitting for locating and securing an elongate channel-shaped carpet cap along a wall at a predetermined height. The fitting comprises a base and a web extending upwardly from the base to an upper edge which in use supports the cap with one limb of the cap extending down behind the back of the web. Further, the web has a series of longitudinally spaced openings, which may be in the form of V-shaped notches extending from the upper edge. Theupper edge of the web is located above the base at the predetermined height to which the cap is to be secured to the wall above a floor or carpet surface.

In use, the cap is supported on the upper edge of the web against the wall with the fitting supported on the floor or already laid carpet. Then, staples are applied to the aforesaid limb of the cap through the aforesaid openings in the web in order to secure the cap to the wall. The fitting may then be removed or solid along the wall to locate and secure an adjacent cap or an adjacent portion of an elongated cap.

The fitting may be in the form of a one piece item of fixed height or alternatively it may comprise an angle section base member and a cap support member defining the web which is mounted on the base member in a manner enabling the top edge height of the web to be adjusted. Typically, the fitting may be about three feet in length.

The invention further resides in the method of locating and securing a carpet cap as set out above.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF PREFERRED EMBODIMENT

Figure 1:
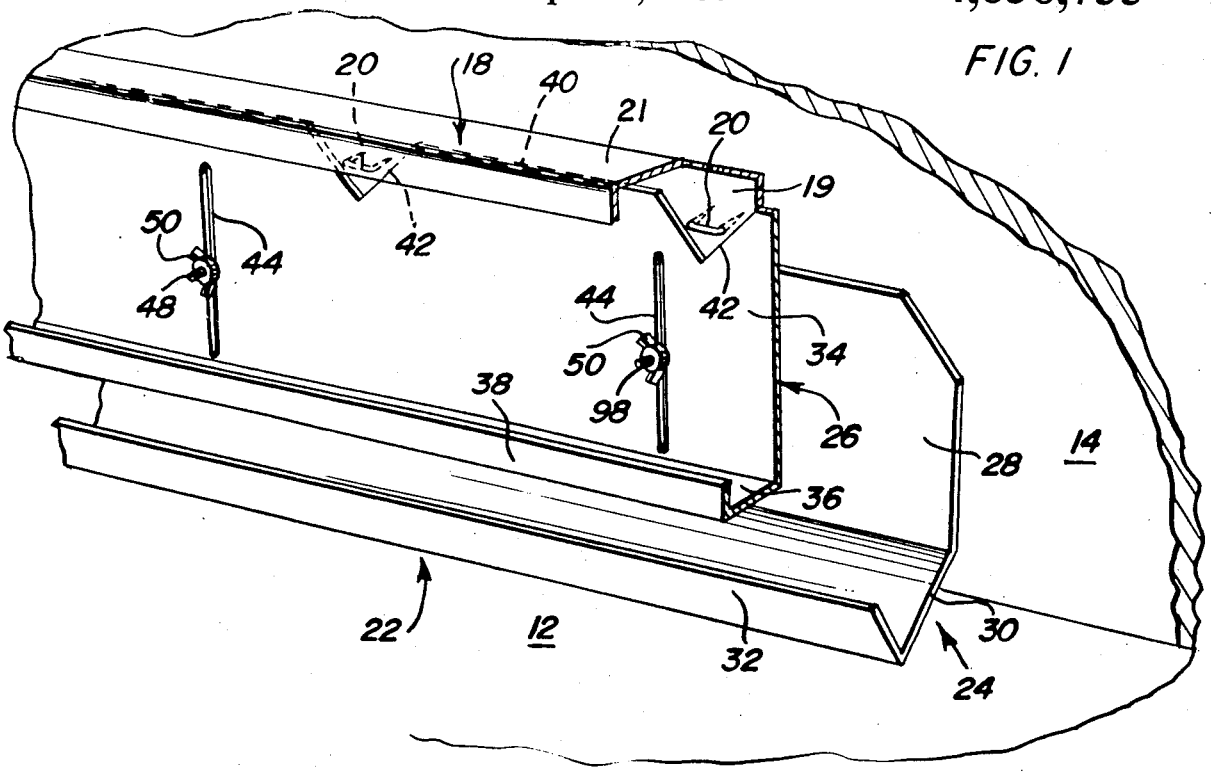
FIG. 1 is an in use perspective view of an end portion of a carpet cap fitting in accordance with the invention showing the cap in position on the fitting.
Figure 2:
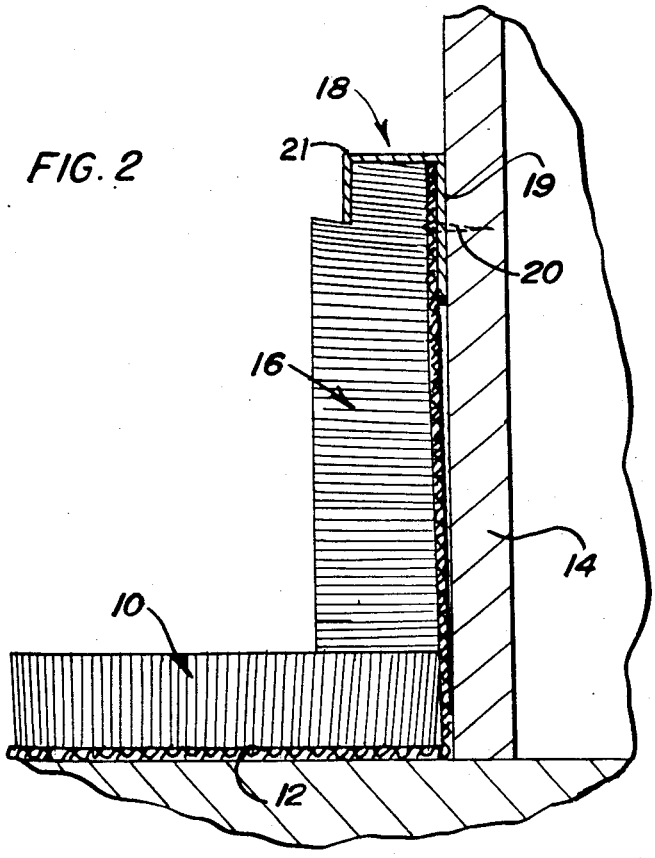
FIG. 2 is an enlarged sectional view of a strip of carpet secured to a wall by a prefitted carpet cap.
Figure 3:
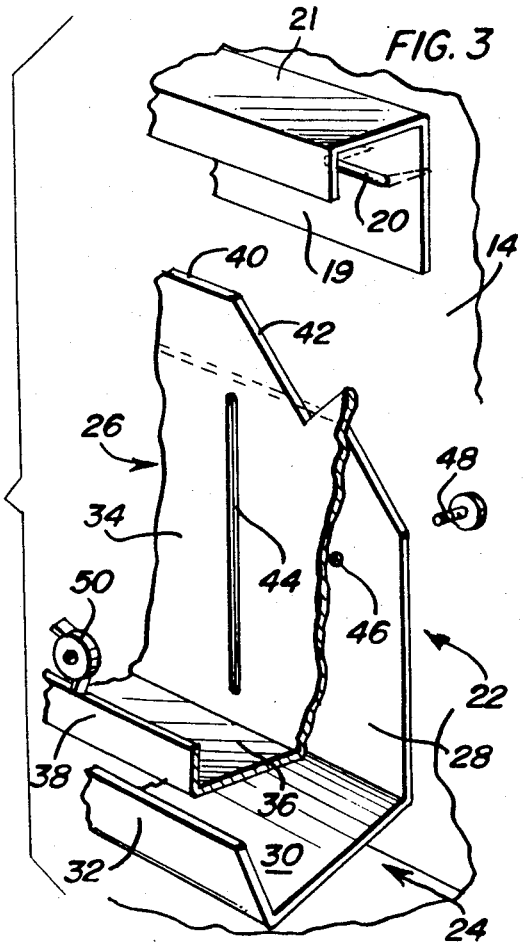
FIG. 3 is an enlarged exploded view of parts of the fitting and cap.

Referring initially to FIG. 2, there is shown a wall to wall carpet 10 which has been laid on a floor 12 adjacent a wall 14. Further, an additional strip of carpet 16 has been laid along the lower margin of the wall in a manner akin to a baseboard and has been secured in place by having its upper edge squeezed into a channel-shaped elongate carpet cap 18 secured to the wall at predetermined height related to the height of strip 16 by a series of staples 20. In order to pre-secure cap 18 to the wall, in accordance with the invention, use is made of a cap locating and securing fitting, generally denoted by reference 22 in FIGS. 1 and 3.

Fitting 22 comprises a base member 24 of suitable material such as thin metal plate or molded plastic and a similarly formed cap support member 26. The base member has an elongate rear wall 28, a base wall 30 and a short upright front wall 32. The cap support member 26 is of similar channel-shaped cross section, having a rear wall or web 34, a base flange or wall 36, and a short front wall 38. Web 34 has a top edge 40 and a series of V-shaped notches 42 formed from the top edge. The overall length of the fitting may, for example, be about three feet and the notches may be spaced at about six inch intervals. The ends of base member 24 may overlap the ends of member 26 by about ⅝ inch. Web 34 of member 26 has elongate slots 44 and wall 28 of member 24 has correspondingly spaced apertures 46. Members 24 and 26 are adjustably interconnected by screws 48 and wing nuts 50 received in the respective apertures and slots, and the slots allow the height of top edge 40 of member 26 to be adjusted relative to the base wall 30.

In use, the height of top edge 40 of member 26 above base wall 30 of member 24 is adjusted by means of the screws 48 and nuts 50 to a height corresponding to the required height of the top of cap 18 above the top of carpet 10. The cap 18 includes a forwardly projecting upper flange 21 which is rested on the top edge 40 so that its depending rear wall 19 of the cap 19 is disposed behind web 34 covering the notches 42. The fitting and supported cap 19 are then moved up to the required position against wall 14 in the correct longitudinal situation and the cap is stapled to the wall by staples 20 inserted through the notches 42 which serve as locating formations for the respective staples. When the cap has been stapled, the fitting can be removed or moved along the cap to the next longitudinal position. When the cap has been secured to the wall along its entire length, and the fitting 22 removed, carpet strip 16 can be inserted in place with its top edge squeezed under the cap. p It will be understood that the adjustable height of member 26 relative to member 24 allows the cap to be located and secured at a range of desired heights above the carpet 10. However, it is also within the scope of the invention to povide a one piece fitting similar in form to member 26 per se and having a fixed height. To provide a range of heights, a range of such one piece fittings could be made available, the advantage being that these are more economical to manufacture than the adjustable fitting herein illustrated. The fittings may be made in 18 to 20 guage aluminum or in a suitable hard plastic or the like. In the illustrated embodiment, the fitting may, for example, have a height adjustment for top edge 40 as between three to four inches above base wall 24.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as new is as follows:

1. In combination with a carpet strip trim cap for trimming the upper marginal edge of a wall base edge mounted carpet strip and wherein said cap includes a vertical rear wall terminating upwardly in a forwardly projecting upper flange, a fitting for positioning and supporting said cap in predetermined elevated position relative to said wall base edge and with said cap held tightly against said wall preparatory to securement of said cap to said wall, said fitting including an upright planar web for opposing and abutting said wall, said web including a forwardly projecting base flange and terminating upwardly in an upper edge paralleling said base flange, said trim cap being supported from said fitting with the underside of said upper flange resting upon said upper edge and said vertical rear wall clamped between the upper marginal edge portion of said web and said room wall by manual pressure applied to said fitting in the direction opposing said wall, said upper marginal portion of said web including openings formed therethrough, said openings including lower extremities spaced above the lower extremity of said vertical rear wall.

2. The apparatus of claim 1 wherein said openings comprise notches spaced along and extending from said upper edge of the web.

3. The apparatus of claim 1 wherein the fitting comprises a base member and a cap-supporting member defining the web, the cap-supporting member being vertically adjustably mounted on the base member so that the cap can be located at different heights, said base flange being carried by said base member.

4. The apparatus of claim 3 wherein the cap-supporting member and base member are interconnected by screw and nut connectors which extend through respective slots in one of the members to adjust the height of the cap supporting member relative to said base member.

5. A method of locating and securing an elongate channel-shaped carpet cap along a wall at a predetermined height above a floor or carpet surface comprising providing an elongate cap-supporting fitting having a base and a web extending upwardly from the base to a cap-supporting edge which is at said predetermined height above the base, the fitting further having plural longitudinally spaced openings in the web, said method including supporting the cap on said edge with one limb of the cap disposed behind the web and extending downwardly over said openings, manually placing the fitting and supported cap on the surface adjacent the wall with said limb of the cap substantially in face to face engagement with the wall and clamped in position on said wall by manual pressure applied to said web in a direction opposing said wall, applying mechanical fasteners to said limb of the cap through the respective openings to secure the cap to the wall, and removing the fitting.

* * * * *